US010138894B1

(12) United States Patent
O'Connor

(10) Patent No.: US 10,138,894 B1
(45) Date of Patent: Nov. 27, 2018

(54) UMBRELLA WITH FAN

(71) Applicant: Loren E. O'Connor, Columbus, GA (US)

(72) Inventor: Loren E. O'Connor, Columbus, GA (US)

( * ) Notice: Subject to any disclaimer, the term of this patent is extended or adjusted under 35 U.S.C. 154(b) by 321 days.

(21) Appl. No.: 15/047,962

(22) Filed: Feb. 19, 2016

Related U.S. Application Data

(60) Provisional application No. 62/118,240, filed on Feb. 19, 2015.

(51) Int. Cl.

| | |
|---|---|
| ***F04D 25/08*** | (2006.01) |
| ***A45B 3/00*** | (2006.01) |
| ***F04D 19/00*** | (2006.01) |
| ***F04D 25/06*** | (2006.01) |
| ***F04D 29/053*** | (2006.01) |
| ***F04D 29/32*** | (2006.01) |
| ***F04D 29/52*** | (2006.01) |
| ***A45B 3/02*** | (2006.01) |

(52) U.S. Cl.
CPC ..... *F04D 25/08* (2013.01); *A45B 3/00* (2013.01); *A45B 3/02* (2013.01); *F04D 19/002* (2013.01); *F04D 25/068* (2013.01); *F04D 25/0693* (2013.01); *F04D 29/053* (2013.01); *F04D 29/325* (2013.01); *F04D 29/522* (2013.01); *A45B 2200/1036* (2013.01)

(58) Field of Classification Search
CPC ..... F04D 25/08; F04D 19/002; F04D 25/068; F04D 25/0693; F04D 29/053; F04D 29/325; F04D 25/522; A45B 3/00; A45B 3/02; A45B 3/04; A45B 23/00; A45B 2200/1009; A45B 2200/1036
USPC ..... 417/423.7; 135/16, 910, 98, 91
See application file for complete search history.

(56) References Cited

U.S. PATENT DOCUMENTS

| | | | | |
|---|---|---|---|---|
| 2,780,615 | A * | 2/1957 | Tawney | C08L 27/06 525/203 |
| 3,177,881 | A | 4/1965 | Covington | |
| 3,373,962 | A * | 3/1968 | Blaiklock | D06F 37/24 248/621 |
| 5,007,811 | A | 4/1991 | Hopkins | |
| D409,369 | S | 5/1999 | Vega | |
| 6,230,723 | B1 | 5/2001 | Hixson | |
| 6,325,084 | B1 | 12/2001 | Cohen | |
| 6,732,752 | B2 * | 5/2004 | Cohen | A45B 3/00 135/16 |
| 6,796,318 | B2 * | 9/2004 | Cohen | A45B 3/00 135/16 |
| 6,840,742 | B2 | 1/2005 | Cohen et al. | |
| 7,034,416 | B2 * | 4/2006 | Simofi-Ilyes | H02K 5/20 310/58 |
| 7,322,208 | B1 | 1/2008 | Griffin | |

(Continued)

*Primary Examiner* — Dominick L Plakkoottam
*Assistant Examiner* — Connor Tremarche
(74) *Attorney, Agent, or Firm* — Cramer Patent & Design, PLLC; Aaron R. Cramer

(57) ABSTRACT

A portable fan capable of attachment to an underside of a traditional patio umbrella has a motor and a counterweight capable of sliding over a support pole of the umbrella. The fan motor is secured to the support pole by means of a compression sleeve around which the fan is built. The fan motor is powered by traditional alternating current in one (1) embodiment or by direct current storage cells in another embodiment. The fan is actuated by a pull cord or by a remote control.

2 Claims, 7 Drawing Sheets

(56) References Cited

U.S. PATENT DOCUMENTS

| | | | | |
|---|---|---|---|---|
| 7,778,624 | B2 * | 8/2010 | Li | A45B 3/04 455/344 |
| 2004/0084071 | A1 | 5/2004 | Gray | |
| 2005/0089364 | A1 * | 4/2005 | Geib | F16B 9/023 403/370 |

* cited by examiner

UMBRELLA WITH FAN

RELATED APPLICATIONS

The present invention was first described in and claims the benefit of U.S. Provisional Application No. 62/118,240, filed Feb. 19, 2015, the entire disclosures of which are incorporated herein by reference.

FIELD OF THE INVENTION

The present invention relates generally to a portable fan capable of attachment to a cylindrical pole, preferably for attachment underneath a patio umbrella.

BACKGROUND OF THE INVENTION

Excessive heat is a constant burden during warm weather conditions, such as those typically experienced during the summer months. Heat stroke, heat exhaustion, and other types of heat illnesses are common occurrences during these circumstances. Various methods for mitigating heat exist, many of which incorporate the use of an air moving device such as a fan.

Common methods also exist for mitigating the heat, such as use of shade producing structures, consumption of cool liquids, and the like. While many such methods are prevalent, they generally require the use of special objects or devices. Many times, a user is required to carry, transport, or otherwise provide a means for beating the heat which causes extra burden to the user. Simple devices such as shade umbrellas and personal fans require a user to carry and manipulate these devices and are often insufficient in their own right to provide a desired level of cooling. An increase in the amount of cooling provided often results in an increased burden on the part of a user and may result in discomfort associated with the manipulation and carrying of multiple items.

Accordingly, there exists a need for a means by which an individual may be effectively cooled while avoiding the increased burden and discomfort associated with the carrying of multiple cooling implements. The use of the umbrella with fan provides a means for cooling and individual in manner which is quick, easy, and effective.

SUMMARY OF THE INVENTION

The inventor has recognized the aforementioned inherent problems and lack in the art and observed that there is a need for an umbrella with a fan.

It is therefore the purpose of the inventor to provide a fan, comprising a housing adaptably mounted to an umbrella pole, a motor supported within the housing with the motor driving a drive pulley, a spindle extending out of the housing which is capable of rotating motion relative to the umbrella pole, an impeller mounted to the spindle and which is driven by the drive pulley in conjunction with the motor, a pull cord adaptably and operably connected to a switch which is in electrical communication between either an external power source or an internal power source and the motor. When the pull cord is activated, the motor drives the drive pulley thereby rotating the impeller.

The housing of the fan further comprises, an upper section which has a plurality of vents, a lower section and a counterweight which is located within each of the upper and lower sections of the housing. The motor is secured within the upper housing while the upper section and the lower housing sections are capable of being securely fastened together. The spindle extends outward from the lower section.

The housing is also removably attached to a compression sleeve which has a sleeve body, a first compression ring and a first compression nut at a first end of the sleeve body and a second compression ring and a second compression nut at a second end of the sleeve body. The sleeve body has an external threaded portion at the first and second ends which permits the fan to be secured to an umbrella pole by passing through a cavity of the sleeve body. This configuration also permits the fan to be secured in place when the first and second compression rings and compression nuts are threadingly secured about the umbrella pole. The impeller is configured to rotate around the compression sleeve while the sleeve is in a fixed position relative to the umbrella pole.

The sleeve body also comprises a conductor channel. The conductor channel is configured to be a longitudinally oriented void along a portion of an interior of the sleeve body configured to permit passage of electrical conductors. The sleeve body also has a first wire aperture located subjacent to the spindle, a second wire aperture located superjacent the spindle, a wire box covering the first wire aperture and a pull cord box secured to an outer face of the wire box. The pull cord is secured within the pull cord box.

The impeller may also comprise a plurality of fan blades each having a flange attached to a planar lower face of the spindle while the fan blades may be composed of a rigid thermoplastic and formed in an injection-molding. The fan may also be configured such that successive activation of the switch variably controls a speed of the motor and may be operated by a remote control device in wireless communication with the switch. The power source is capable of being solar. The sleeve body may comprise a rigid thermoplastic.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
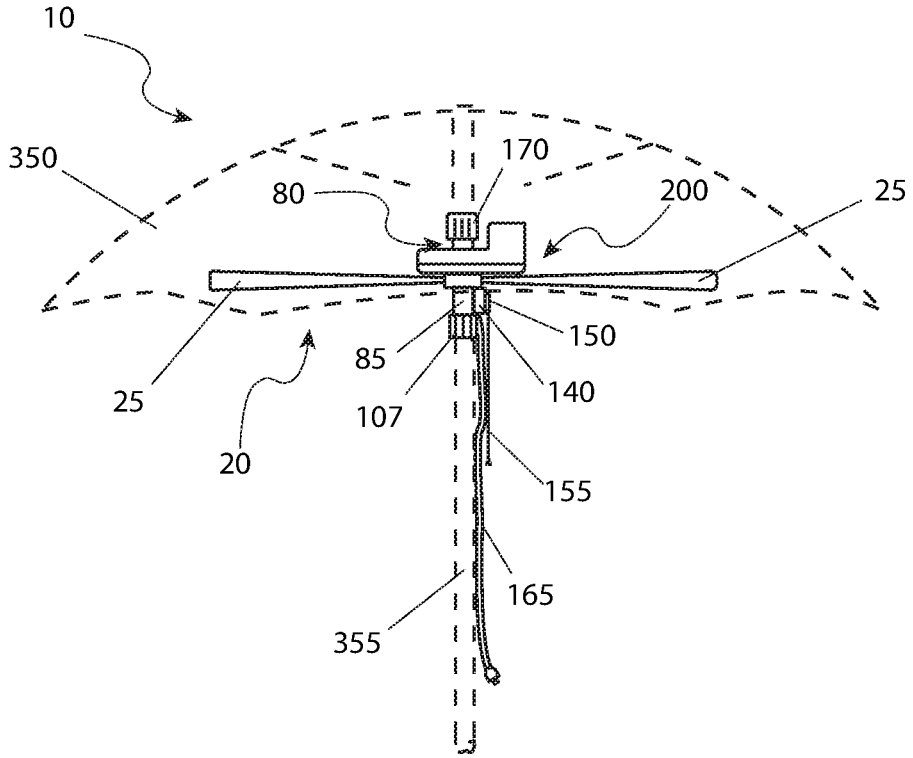
FIG. 1 is a breakaway view of an umbrella 350 with a fan 10 in accordance with the preferred embodiment of the present invention.

10 fan
20 impeller

25 blade
30 flange
35 blade fastener
40 spindle
45 lower face
50 bore
60 key
65 bearing seat
70 bearing shoulder
75 bearing
80 compression sleeve
85 sleeve body
90 first end
95 second end
100 external thread
105 compression ring groove
110 compression ring
115 retainer nut
120 snap ring groove
125 snap ring
130 conductor channel
135 first wire aperture
140 second wire aperture
145 wire box
150 pull cord box
155 pull cord
160 pull switch
165 conductor
170 compression nut
175 external surface
180 internal thread
185 ring face
190 pole aperture
200 housing
205 housing upper section
210 housing lower section
215 vent slot
220 seal
225 counterweight
230 motor
235 mounting fastener
240 output shaft
245 pulley retainer
250 drive pulley
255 drive belt
260 impeller pulley
270 remote actuator
275 case
280 power source
285 operator
290 signal emitter
295 switch signal
300 electrical system
305 controller
310 receiver
320 battery
325 socket
330 electrical wire
335 dc motor
350 umbrella
355 umbrella pole fastener

DETAILED DESCRIPTION OF THE PREFERRED EMBODIMENT

Figure 5:
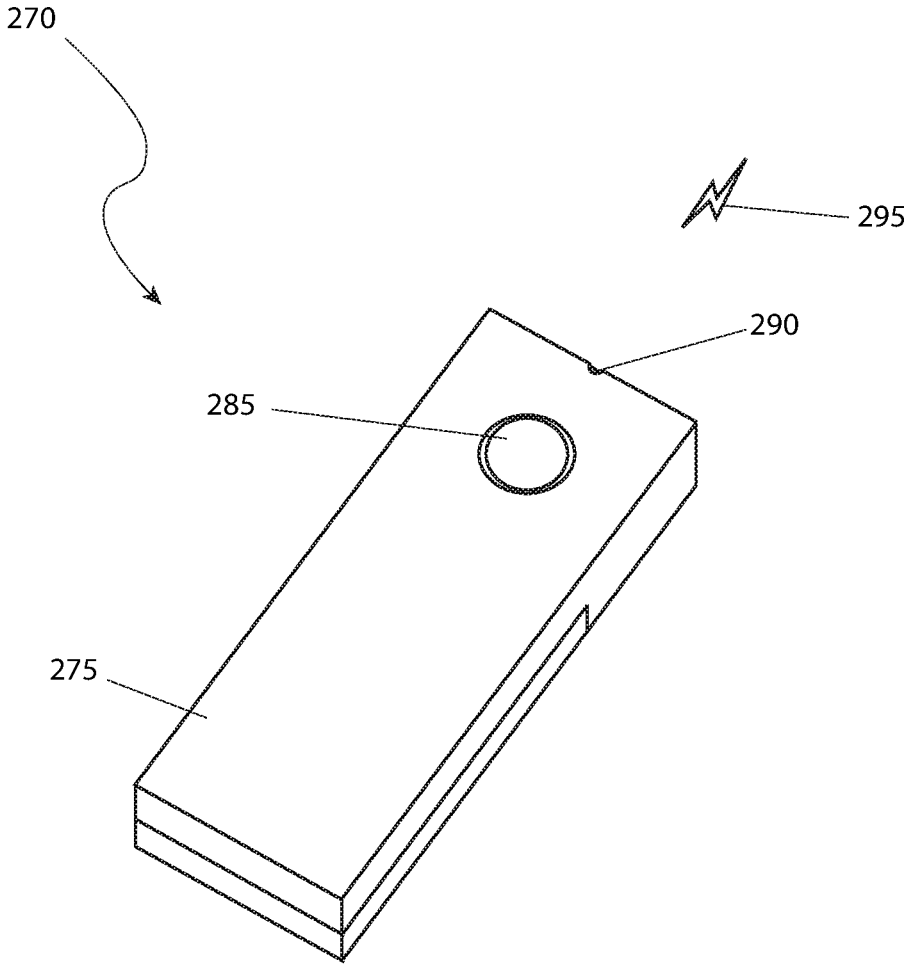
FIG. 5 is an isolated view of a remote actuator 270 for the fan 10 in accordance with the preferred embodiment of the present invention.
Figure 6:
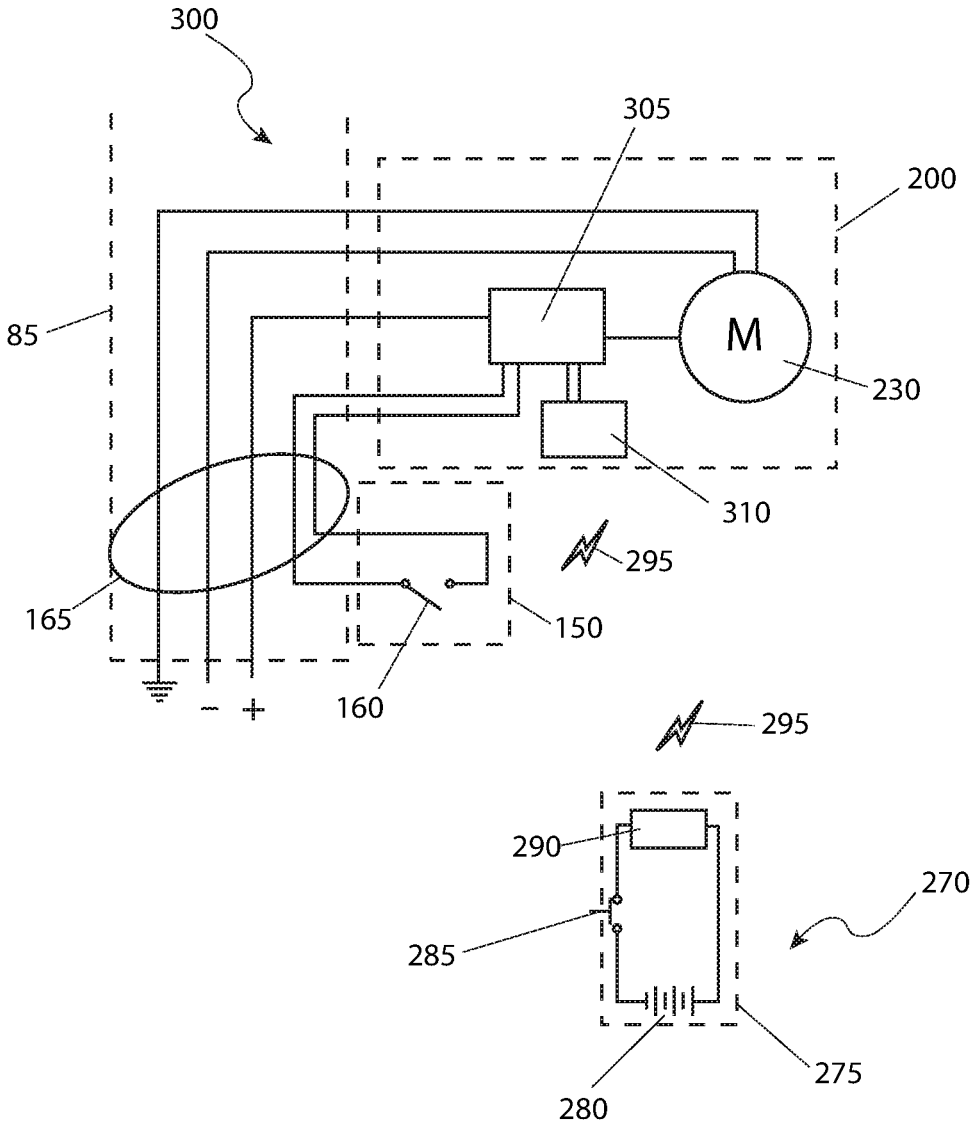
FIG. 6 is a block diagram of the electrical system 300 of the fan 10 in accordance with the preferred embodiment of the present invention; and, FIG. 7 is an isolated view of the fan 10 powered by a battery 320 in accordance with an alternate embodiment of the present invention.
Figure 7:
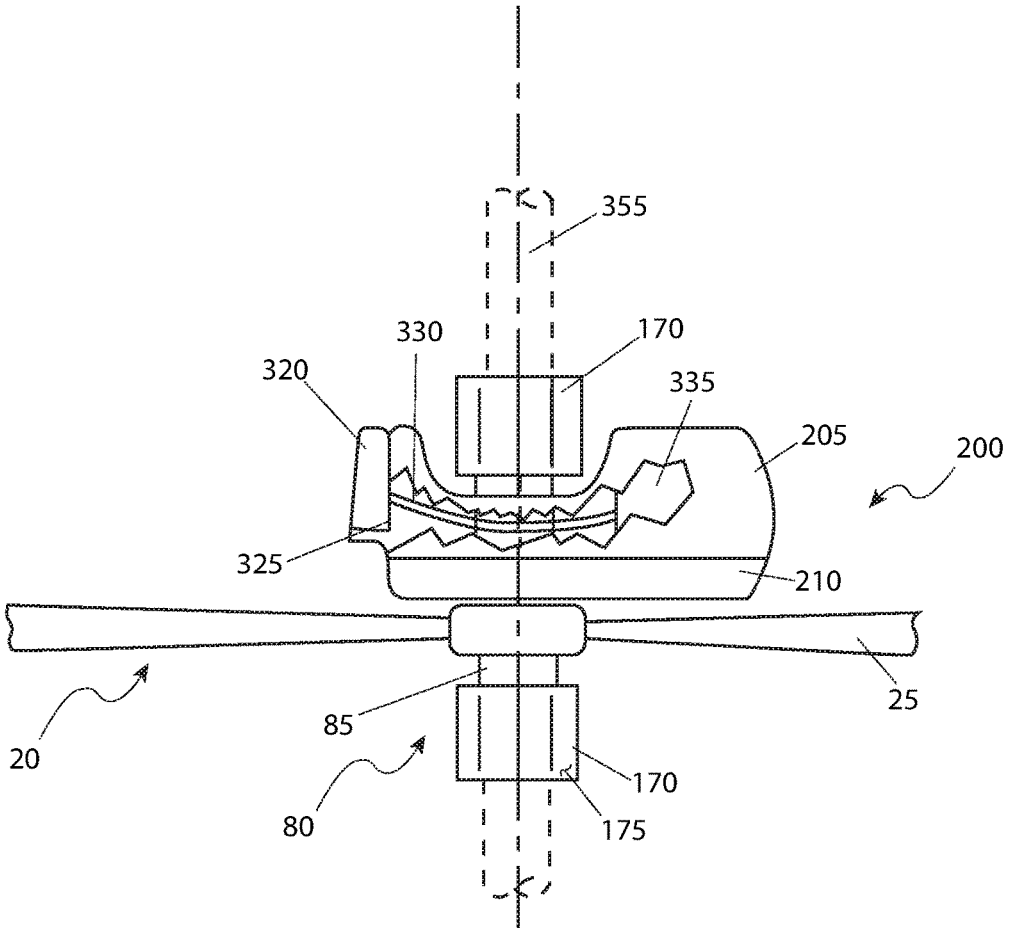

The best mode for carrying out the invention is presented in terms of its preferred embodiment, herein depicted within FIGS. 1 through 6, and an alternate embodiment, herein depicted in FIG. 7. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes an umbrella 350 with a fan (herein referred to as the "device") 10, which provides a means to achieve positive ventilation in an area under a patio umbrella 350. The impeller 20 of the device 10, in a preferred embodiment, is belt 255 driven by an electric motor 230 having three (3) speed settings.

Figure 2:
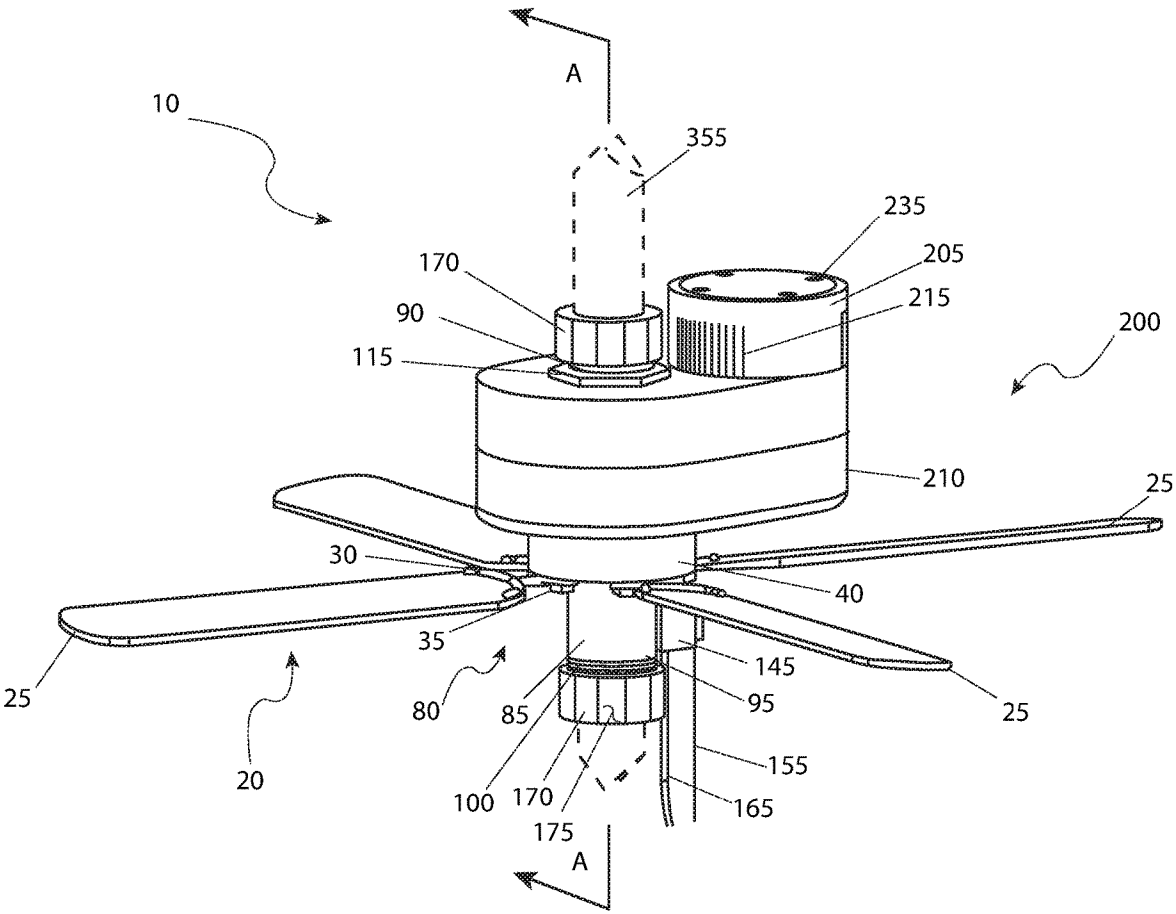
FIG. 2 is an isolated view of the fan 10 in accordance with the preferred embodiment of the present invention.
Figure 3:
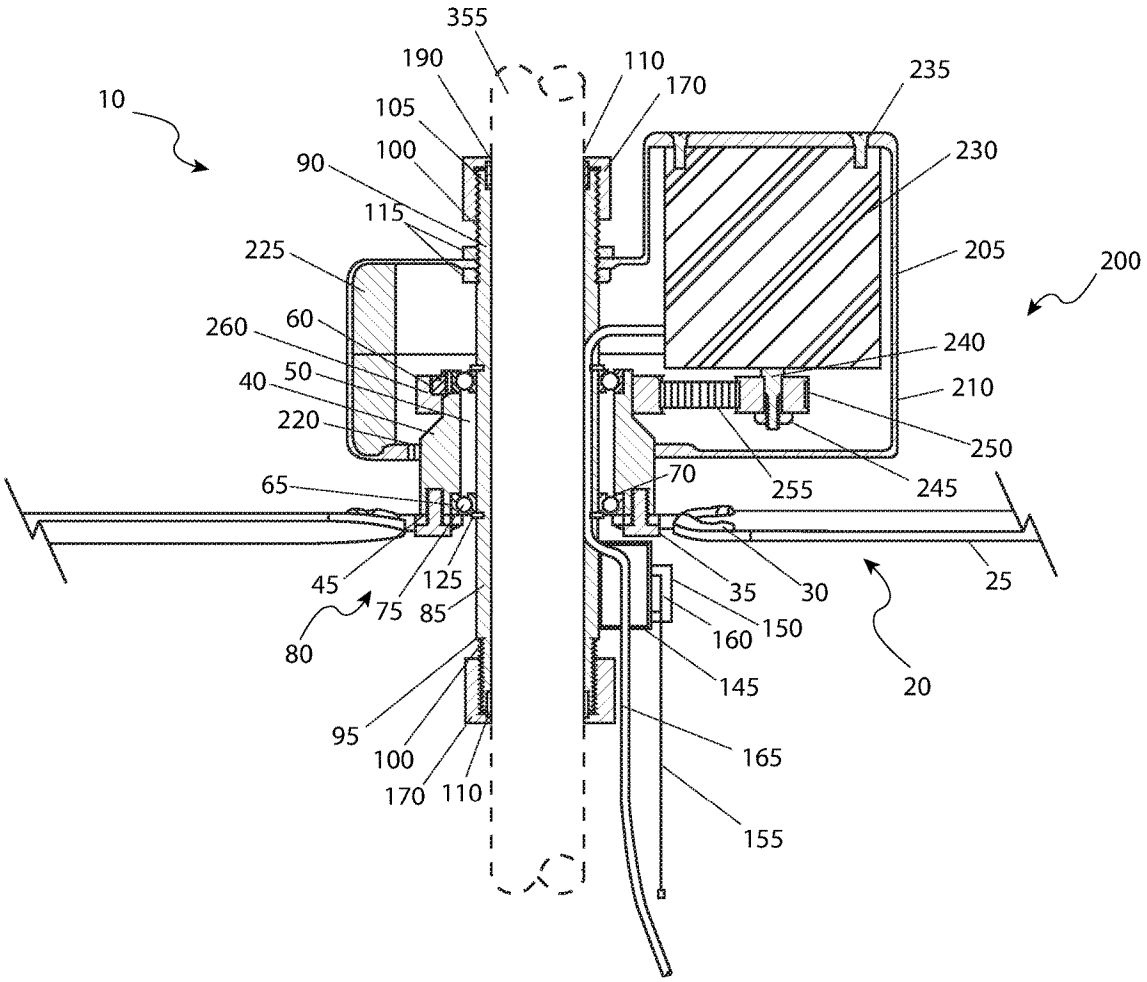
FIG. 3 is a cross section along line A-A as seen in FIG. 2 cut through a housing 200 of the fan 10 in accordance with the preferred embodiment of the present invention.
Figure 4:
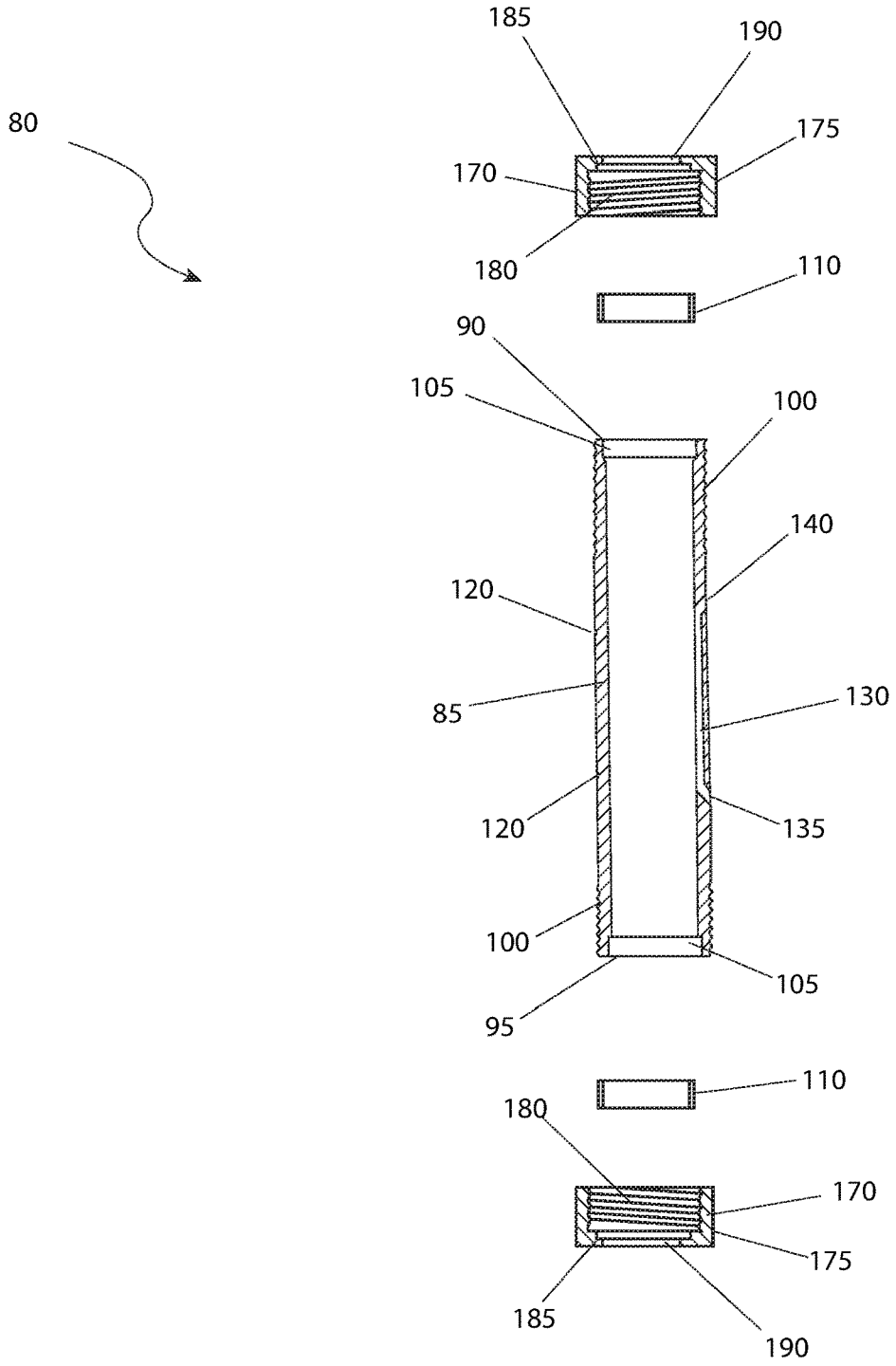
FIG. 4 is a cross-sectional view of an exploded compression sleeve 80 of the fan 10 in accordance with the preferred embodiment of the present invention.

Referring now to FIG. 1, a breakaway view, and FIG. 2, an isolated view of the device 10, according to the preferred embodiment of the present invention, are disclosed. The device 10 includes a motor 230, as seen in FIG. 3, enclosed within a housing 200 providing the motive force for an impeller 20 mounted by a user to an umbrella pole 355 of their own umbrella 350. The device 10 is envisioned to be mounted well into the protection of the umbrella 350 so as be located a sufficient distance above a user to obviate the need for any protective guarding. The housing 200 is composed of a thermoplastic material and constructed from injection-molded parts comprising a housing upper section 205 and a housing lower section 210. The housing lower section 205 is fastened to the housing upper section 210 by means of a plurality of threaded fasteners (not shown) spaced around the periphery of the housing sections 205, 210. The housing sections 205, 210 are provided with encircling walls joined to abutting end plates so as to define an interior. The end plates of the housing upper section 205 are on two (2) planar levels. The housing sections 205, 210 are provided with any additional material surrounding any aperture, or other feature, as is necessary to withstand the operational forces exerted thereon. The housing upper section 205 is removably attached to a compression sleeve 80, as depicted in FIGS. 3 and 4, in such a manner as to obviate any relative motion. A plurality of vent slots 215 is disposed in the housing upper section 205 to provide a free flow of air into and out of the housing 200 for ventilation to the motor 230.

A lower end of a spindle 40 protrudes from the bottom of the housing lower section 210. The spindle 40, as more clearly illustrated in FIG. 3, is generally cylindrical and is provided with a cylindrical bore 50. A plurality of blades 25 is attached to a planar lower face 45 of the spindle 40 to form the impeller 20. The blades 25 are composed of a rigid thermoplastic and formed in an injection-molding process and as such may be presented in a wide variety of colors and surface finish textures. Other materials, such as wood, or metal, may be utilized without limiting the scope of the device 10. Each blade 25 is provided with an attached flange 30, having the requisite apertures (not shown) to accommodate a plurality of threaded blade fasteners 35 to accomplish a removable connection to the spindle 40. The flange 30 of each blade 25 is configured to be a generally cylindrical shaft with an arcuate bracket at either end to connect the blade 25 to the spindle 40 and dispose the blade 25 at some inclined angle with the horizontal so as to displace air in a downward direction to achieve the purpose of the device 10. The flange 30 and the blade 25 may also be formed as a single piece with consideration being made for the correct disposition of the blade 25. The spindle 40 is provided with threaded apertures (not specifically shown) along the lower face 45 to accept the blade fasteners 35.

Referring now to FIG. 3, a section view along line A-A as seen in FIG. 2, of the device 10, according to the preferred embodiment of the present invention, is disclosed. The device 10 includes a counterweight 225 built into the housing 200 to balance against the eccentric weight of the motor 230. A compression sleeve 80, as portrayed in greater detail in FIG. 4, is configured to include a sleeve body 85, and a compression ring 110 with a compression nut 170 at a first end 90, as well as a compression ring 110 with a compression nut 170 on a second end 95. The sleeve body 85 is a rigid, thermoplastic, cylindrical shell, such as PVC pipe, approximately eight inches (8 in.) long. The sleeve body 85 is provided with an extended external thread 100 at the first end 90 and another external thread 100 at the second end 95. Disposed in the sleeve body 85 is a conductor channel 130 configured to be a longitudinally oriented void along a portion of the interior diameter to provide a passageway for the routing of conductors 165 to the motor 230 so as to circumvent the impeller 20. The conductor channel 130 is provided with a first wire aperture 135 and a second wire aperture 140 on the outside diameter of the sleeve body 85 for the entrance and the exit of the conductors 165. The first wire aperture 135 is located subjacent to the spindle 40 while the second wire aperture 140 is located above the location of the spindle 40 on the sleeve body 85. A wire box 145 is attached to the sleeve body 85 in such a manner as to conceal the first wire aperture 135. The wire box 145 is configured to be a metal, or thermoplastic, shell, having appropriate fittings to accommodate a coded entrance and exit of the conductor 165. The wire box 145 may also be provided with a removable cover for access to the conductor 165 and the routing thereof. A box aperture (not shown) is in alignment with the first wire aperture 135 so that the conductor channel 130 and the interior of the wire box 145 are in communication so as to expedite routing of the conductor 165.

A pull cord box 150 is attached to an outer face of the wire box 145. The pull cord box 150 is a metal, or a thermoplastic, shell housing a pull switch 160 utilized to control the energizing and speed control of the motor 230. The pull switch 160 is activated by a pull cord 155 connected thereto and suspended from the pull cord box 150. The pull cord 155 is composed of a textile filament of any natural or synthetic fiber. Other materials, such a metal bead link chain, may be utilized without limiting the scope of the device 10. A user can easily access the pull cord 155 to energize the device 10 or alter the rotational speed of the impeller 20. The pull switch 160 is configured to index the rotational speed of the motor 230, via a controller 305 in the electrical system 300, through each successively increasing increment to an "off", or de-energized state. The pull cord 155 may be provided with some type of a fob in order to provide a surface which may be more easily grasped by the user to operate the pull switch 160.

The impeller 20 is configured to rotate around the compression sleeve 80 as the compression sleeve 80 is fixed relative to the umbrella pole 355. To accomplish this function, the rotating spindle 40 is mounted with a pair of bearings 75 to the compression sleeve 80. The bearings 75 are commercially available angular contact ball bearings 75. Other types of rolling elements, such as tapered-roller bearings 75, or combinations of element types, such as thrust and needle, may be utilized with concurrent adaptive considerations, without limiting the scope of the device 10. The inner races of the bearings 75 are fitted to the outside diameter of the sleeve body 85 and restrained in a vertical relationship by retaining devices, such as snap rings 125 held in snap ring grooves 120 cut, or formed, into the sleeve body 85. The outer races of the bearings 75 are held in bearing seats 65 cut into the bore 50 at an upper end and a lower end of the spindle 40. The outer races of the bearings 75 are further restrained within the spindle 40 by the opposing bearing shoulders 70 in proximity to the upper and the lower ends of the spindle 40.

A retainer nut 115 is rotationally installed onto the elongated external thread 100 at the first end 90 of the sleeve body 85. The first end 90 of the sleeve body 85 is inserted through an aperture (not specifically shown) in the housing upper section 205 from the interior to the exterior. A second retainer nut is rotationally inserted onto the external thread 100 on the outer face of the housing upper section 205 and tightened against that outer face to secure the housing upper section 205 to the sleeve body 85. This method of attachment has a beneficial effect in sealing the housing 200 to the sleeve body 85 to inhibit the ingress of moisture and other contaminants.

Disposed in the first end 90 of the sleeve body 85 is a compression ring groove 105 configured to be a countersink in the internal diameter of the sleeve body 85. A compression ring 110 is fitted into the compression ring groove 105. The compression ring 110 is an annular ring composed of a resilient elastomer having an internal diameter closely matching the diameter of the umbrella pole 355. The wall thickness and the length of the compression ring 110 are sufficient to affect an interference fit between the umbrella pole 355 and the sleeve body 85 sufficient to retain the device 10 when compressed in place by a compression nut 170. The countersink diameter of the compression groove 105 would be slightly less than the outside diameter of the compression ring 110 in a relaxed state, while the depth would be approximately equal to seventy-five to eighty percent (75%-80%) of the relaxed length thereof. The hardness of the compression ring 110, as measured in durometer, should be sufficient to achieve the proper retention force upon being compressed without the assistance of hand tools by an average user. The compression nut 170 is composed of the same constituent material as the sleeve body 85. The compression nut 170 is provided with an internal thread 180 complimentary to the external thread of the sleeve body 85. The compression nut 170 is further configured to be of a sufficient size to have additional internal formed features, such as a ring face 185, as is typical of similar compression-type fittings like some plumbing fittings. The ring face 185 will contact an end face of the compression ring 110 in order to accomplish the intended compression thereof when the internal thread 180 of the compression nut 170 is engaged into the external thread 100 of the sleeve body 85. Disposed in an end of the compression nut 170 opposite from the internal thread 180 is a pole aperture 190 of a sufficient size to permit the unrestricted clearance for the umbrella pole 355. An external surface 175 of the compression nut 170 is provided with ridges, knurling, or other embossment, including hexagonal flanges, to assist the user to more firmly grip the compression nut 170 during the tightening process thereof. The second end 95 of the sleeve body is similarly configured to include a compression ring groove 105, a compression ring 110, and a compression nut 170, having all of the previously enabled features, as a further aid in the retention of the device to the umbrella pole 355.

The motor 230 is attached to the interior of the housing 200, preferably to the housing upper section 205, by means of a plurality of mounting fasteners 235 inserted through apertures (not specifically shown) and threaded into some accommodating feature of the motor 230. It may be necessary to incorporate other provisions into the housing 200 to stay any additional undesirable relative movement of the motor 230, however, it is understood that any such eventualities do not modify the scope or intent of the present device 10 and this preferred embodiment does not preclude any other embodiment. The motor 230 is comprised of any of a variety of commercially available, copper wound, small frame, multiple speed, alternating current motors 230 with a cylindrical output shaft 240, preferably equipped with a pulley retainer 245, capable of generating sufficient torque to induce the desired motion in the spindle 40. The motor 230 is electrically powered, through a controller 305, by a standard residential 110-V supply carried through the conductors 165 of the electrical system 300.

Disposed on the output shaft 240 of the motor 230 is a drive pulley 250 utilized to transmit the output torque to rotate the impeller 20. The pulley retainer 245 is configured to be a standard jam nut capable of securing the drive pulley 250 against a shoulder, or a taper, of the output shaft 240 to achieve the full transmission of the output power. Other techniques, such as keys and retaining rings, or eccentric clamps, may be utilized to attach the drive pulley 250 without limiting the scope of the device 10. The drive pulley 250 is composed of a rigid thermoplastic in order to minimize the weight of the device 10. Other materials, such as lightweight metals, may also be utilized.

The output power of the motor 230 is transmitted from the drive pulley 250 to an impeller pulley 260 by means of an encircling drive belt 255. The drive belt 255 is a toothed belt, having uniformly spaced ridges, or cogs, along an interior face capable of engaging with complimentary indentations in the drive faces of the pulleys 250, 260, composed of a resilient elastomer so as to maintain a correct belt tension. Other types of drive belts 255, utilizing tensioning idlers, or other types of drive systems, such as sprockets and chain, may be utilized for the transmission of power without limiting the scope of the device 10. The impeller pulley 260 is similar to the drive pulley 250, having a complimentary profile in keeping with the drive belt 255, attached to the upper end of the spindle 40. The impeller pulley 260 is sized, relative to the drive pulley 250, appropriately to result in a correct ratio to deliver the intended rotational speed of the spindle 20, and by direct connection the impeller 20. The impeller pulley 260 is pressed onto the spindle 20 and secured in an absolute relative position by means of a key 60. In a preferred embodiment, the key 60 is composed of a socket-head set screw inserted into a threaded cavity adaptively configured to comprise equal portions of the impeller pulley 260 and the spindle 40. It is understood that other types of keys 60, or splines, or other methods of attachment, including fabrication as a single piece, may be utilized without limiting the scope of the device 10.

As previously stated, the lower end of the spindle 40 protrudes through an aperture in the bottom of the housing lower section 210. A seal 220 is installed in that aperture and has a resilient elastomer lip in contact with the spindle 40. Other materials, such as a dense felt material, may be utilized for the sealing interface without limiting the scope of the device 10. The seal 220 will inhibit the ingress of moisture and other contaminants to the housing 200.

At the time of installation, it is envisioned that the device 10 would essentially be completely assembled, with the exception of the blades 25 of the impeller 20, with the compression nuts 170 loosened so as to permit the free passage of the umbrella pole 355 through the sleeve body 85 by inserting a lower end of the umbrella pole 355 therein. The device 10, without the blades 25, would be elevated to the desired height along the umbrella pole 355. The compression nuts 170 would each be rotationally advanced along the sleeve body 85 so as to deform the compression rings 110 thereby affixing the device to the umbrella pole 355. The blades 25 would then be fastened, in turn to the lower face 45 of the spindle 40 utilizing the blade fasteners 35 and the appropriate tool.

It is envisioned that, in an alternate embodiment, the device 10 may be provided with a low voltage, dc motor 335 (direct current) and be in electrical communication with a remotely located solar panel configured to provide a sufficient electromotive force to operate the device 10.

Referring now to FIG. 5, an isolated view of the remote actuator 270, and FIG. 6, a block diagram of the electrical system 300 of the device 10, according to the preferred embodiment of the present invention, are disclosed. The remote device 270 is utilized to provide a wireless switch signal 295 to a controller 305 via a receiver 310 in the electrical system 300 in order to index the rotational speed of the motor 230 thereby influencing the rotational speed of the impeller 20. The remote actuator 270 includes a power source 280 and a signal emitter 290 enclosed within a case 275. The case 275 is composed of a thermoplastic material and constructed from a plurality of injection-molded parts to form an enclosure for the power source 280, the signal emitter 290, and an operator 285. The case 275 is capable of being selectively opened by a user for the installation, or servicing of, the power source 280. The power source 280 may be a battery of any current technology, or another device, such as a capacitor, capable of holding an electrical charge and supplying that charge as an electromotive force to the signal emitter 290 via the operator 285 in order to accomplish the proper function thereof. The operator 285 is a common push-button switch capable of momentarily placing the signal emitter 290 in electrical communication with the power source 280. The signal emitter 290 is a standard electronic device capable of producing a switch signal 295 as an infrared light pulse, or any other wireless signal of current technology, and transmitting that signal 295 to a receiver 310 in the housing 200. The receiver 310 is in electrical communication with the controller 305 which will affect a change in the rotational speed of the motor 230 to the next higher setting, or to de-energize from the highest speed. The switch signal 295 is intended to have the same effect on the controller 305 as the input from the pull switch 160.

Referring now to FIG. 7, an isolated view of the device 10 powered by a rechargeable battery 320, according to an alternate embodiment of the present invention, is disclosed. In an alternate embodiment, a commercially available rechargeable battery 320 is inserted into a socket 325 provided in some portion of the housing 200 adapted to accommodate such a socket 325. A DC motor 335, comprised of a commercially available, low voltage, multiple speed, DC motor 335 is adapted to perform adequately in the device 10. The controller 305, of the appropriate voltage requirement, is in electrical communication with the battery 320 via electrical wires 330 to energize the dc motor 335 to the required level for each speed setting.

In accordance with the invention, the illustrated embodiment can be utilized by an enabled individual in a simple and straightforward manner with little or no training. After initial purchase or acquisition of the device 10, it would be installed as indicated in FIG. 1. The method of installing and utilizing the device 10 may be achieved by performing the following steps: acquiring a model of the device 10 having a desired style to suit the taste of a user; installing the device 10 onto the selected umbrella pole 355 according to the previously disclosed procedure; connecting the conductor 165 to the correct power supply; installing the appropriate power source 280 into the remote actuator 270; utilizing either the pull switch 160, located on the sleeve body 85, via the pull cord 155, or the operator 285 of the remote actuator 270 to set the desired rotational speed of the impeller 20; and going about one's usual activities with the increased ventilation supplied by the device 10.

The method of utilizing the alternate embodiment of the device 10 may be achieved by performing the following steps: acquiring the device 10; installing the device 10 as previously described; installing a fully charged battery 320 into the socket 325 on the housing 200; and operating the device 10 as previously described.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A fan, comprising:

a housing adaptably mounted to an umbrella pole comprising:

an upper section having a plurality of vents;

a lower section; and, a counterweight located within each of said upper and lower sections;

wherein said motor is supported within said upper housing;

wherein said upper section and said lower section are capable of being securely fastened together; and, wherein a spindle extends outward from said lower section;

a motor supported within said housing, said motor driving a drive pulley;

said spindle extending out of said housing, capable of rotating motion relative to said umbrella pole;

an impeller, driven by said drive pulley with said motor, said impeller mounted to said spindle;

a pull cord adaptably and operably connected to a switch in electrical communication between a power source and said motor; and, a compression sleeve comprising:

a sleeve body comprising:

a conductor channel configured to be a longitudinally oriented void along a portion of an interior of said sleeve body to permit passage of electrical conductors;

a first wire aperture located subjacent to said spindle;

a second wire aperture located superjacent to said spindle;

a wire box covering said first wire aperture; and, a pull cord box secured to an outer face of said wire box;

wherein said pull cord is secured within said pull cord box;

a first compression ring and a first compression nut at a first end of said sleeve body; and, a second compression ring and a second compression nut at a second end of said sleeve body;

wherein said sleeve body has an external threaded portion at said first and second ends permitting said fan to be secured to said umbrella pole passing through a cavity of said sleeve body and secured in place by said first and second compression ring and compression nuts being threadingly secured about said umbrella pole; and, wherein said impeller is configured to rotate around said compression sleeve as said sleeve is fixed relative to said umbrella pole;

wherein said housing is removably attached to said compression sleeve; and, wherein when said pull cord is activated, said motor drives said drive pulley thereby rotating said impeller.

2. A fan, comprising:

a housing adaptably mounted to an umbrella pole comprising:

an upper section having a plurality of vents;

a lower section; and, a counterweight located within each of said upper and lower sections;

wherein said motor is supported within said upper housing;

wherein said upper section and said lower section are capable of being securely fastened together; and, wherein a spindle extends outward from said lower section;

a motor supported within said housing, said motor driving a drive pulley;

said spindle extending out of said housing, capable of rotating motion relative to said umbrella pole;

an impeller, driven by said drive pulley with said motor, said impeller mounted to said spindle;

a pull cord operably connected to a switch in electrical communication between an on-board power source and said motor; and a compression sleeve comprising:

a sleeve body comprising:

a conductor channel configured to be a longitudinally oriented void along a portion of an interior of said sleeve body to permit passage of electrical conductors;

a first wire aperture located subjacent to said spindle;

a second wire aperture located superjacent to said spindle;

a wire box covering said first wire aperture; and, a pull cord box secured to an outer face of said wire box;

wherein said pull cord is secured within said pull cord box;

a first compression ring and a first compression nut at a first end of said sleeve body; and, a second compression ring and a second compression nut at a second end of said sleeve body;

wherein said sleeve body has an external threaded portion at said first and second ends permitting said fan to be secured to said umbrella pole passing through a cavity of said sleeve body and secured in place by said first and second compression ring and compression nuts being threadingly secured about said umbrella pole; and, wherein said impeller is configured to rotate around said compression sleeve as said sleeve is fixed relative to said umbrella pole;

wherein said housing is removably attached to said compression sleeve; and, wherein when said pull cord is activated, said motor drives said drive pulley thereby rotating said impeller.

* * * * *